US009216883B2

(12) United States Patent
Williams et al.

(10) Patent No.: US 9,216,883 B2
(45) Date of Patent: Dec. 22, 2015

(54) CLAMP-ON FORK LIFT ATTACHMENT WITH STABILIZER BAR

(71) Applicants: David A. Williams, Milton, FL (US); Aaron Floyd, Cantonment, FL (US)

(72) Inventors: David A. Williams, Milton, FL (US); Aaron Floyd, Cantonment, FL (US)

(73) Assignee: Daws Manufacturing Co., Inc., Pensacola, FL (US)

( * ) Notice: Subject to any disclaimer, the term of this patent is extended or adjusted under 35 U.S.C. 154(b) by 358 days.

(21) Appl. No.: 13/784,185

(22) Filed: Mar. 4, 2013

(65) Prior Publication Data

US 2014/0248111 A1 Sep. 4, 2014

(51) Int. Cl.

| | |
|---|---|
| ***E02F 3/96*** | (2006.01) |
| ***B66F 9/14*** | (2006.01) |
| ***B66F 9/12*** | (2006.01) |
| ***E02F 9/26*** | (2006.01) |

(52) U.S. Cl.

CPC . *B66F 9/12* (2013.01); *E02F 3/962* (2013.01); *E02F 9/26* (2013.01)

(58) Field of Classification Search

CPC ..... E02F 3/962; B66F 9/142; B66F 9/143; B66F 9/144

USPC ..... 414/724

See application file for complete search history.

(56) References Cited

U.S. PATENT DOCUMENTS

| | | | | |
|---|---|---|---|---|
| 1,435,290 | A | 11/1922 | Greenleaf | |
| 1,796,737 | A | 3/1931 | Van Buskirk | |
| 2,699,601 | A | 1/1955 | Darnell | |
| 2,705,380 | A | 4/1955 | Hensley | |
| 2,864,184 | A | 12/1958 | Fohr | |
| 3,312,361 | A * | 4/1967 | Foster | 414/724 |
| 3,325,023 | A | 6/1967 | Coleman | |
| 3,743,358 | A | 7/1973 | Guest | |
| 3,790,010 | A | 2/1974 | Stirling et al. | |
| 3,834,567 | A | 9/1974 | Miller | |
| 3,908,844 | A | 9/1975 | Duffield | |
| 3,913,764 | A | 10/1975 | Stirling et al. | |
| 4,076,314 | A | 2/1978 | Dodich | |
| 4,189,854 | A | 2/1980 | Haynes | |
| 4,274,798 | A | 6/1981 | Guest | |
| 4,411,585 | A | 10/1983 | Quinn | |
| 4,420,189 | A | 12/1983 | von Ruden | |
| 4,560,318 | A * | 12/1985 | Rodgers et al. | 414/724 |
| 4,597,205 | A | 7/1986 | Guest | |
| 4,671,000 | A | 6/1987 | Kim | |
| 4,782,607 | A | 11/1988 | Frisbee et al. | |
| 4,910,891 | A | 3/1990 | Martin et al. | |
| 5,097,609 | A | 3/1992 | Swaggert | |
| 5,273,375 | A | 12/1993 | Plourde | |
| 5,615,499 | A | 4/1997 | McGuire et al. | |
| 5,943,798 | A | 8/1999 | McGuire et al. | |
| 6,022,184 | A | 2/2000 | Friedland | |
| 6,487,799 | B2 | 12/2002 | Burk | |
| D527,029 | S | 8/2006 | Launder et al. | |
| D599,974 | S | 9/2009 | Old | |
| 8,328,470 | B2 * | 12/2012 | Maher | E02D 3/046 405/232 |
| 2004/0108738 | A1 * | 6/2004 | Marry | B66F 9/18 414/785 |

* cited by examiner

*Primary Examiner* — Gerald McClain
(74) *Attorney, Agent, or Firm* — GrayRobinson, PA

(57) ABSTRACT

A clamp-on fork lift attachment having spaced tines which may be temporarily secured to the blade portion of a loader bucket used on equipment such as backhoe loaders and front end loaders includes a lifting plate, a leveling indicator, tie-down elements and a stabilizer bar connected between the spaced tines.

25 Claims, 4 Drawing Sheets

CLAMP-ON FORK LIFT ATTACHMENT WITH STABILIZER BAR

FIELD OF THE INVENTION

This invention relates to devices for use with equipment having a loader bucket, and, more particularly, to a clamp-on fork lift attachment which may be secured to the blade portion of the loader bucket allowing the equipment to function as a fork lift.

BACKGROUND OF THE INVENTION

Fork lifts are commonplace in industry and widely used for moving objects resting on pallets and for other purposes. Equipment of this type generally includes a motorized truck having a vertically oriented carriage along which two spaced forks or tines are moveable in and up and down direction. The tines may also be moved toward and away from the truck to assist with the manipulation of loads placed on the tines.

While dedicated fork lifts of the type described above are effective and useful in a variety of applications, they are not always available on job sites and many do not have the size or lifting capacity to handle larger loads. One solution to this problem has been suggested, for example, in U.S. Pat. Nos. 6,022,184; 4,274,798 and 3,325,023. These patents disclose fork lift attachments which may be temporarily clamped onto the blade portion of the loader bucket found on equipment such as backhoe loaders and front end loaders. Generally, fork lift attachments comprise two tines which are spaced from one another and clamped onto the substantially planar blade portion of the loader bucket immediately rearward from its cutting edge. Each tine has a lower bearing surface that extends beneath the blade portion of the loader bucket and a screw-type clamp that contacts the top surface of the blade such that the blade is sandwiched between the clamp and lower bearing surface. The backhoe loader, front end loader or other piece of equipment with a loader bucket is thus temporarily converted to a fork lift and may be employed to lift and manipulate objects in the manner of a dedicated fork lift.

SUMMARY OF THE INVENTION

This invention is directed to a clamp-on fork lift attachment which may be temporarily secured to the blade portion of a loader bucket used on equipment such as backhoe loaders and front end loaders.

In one presently preferred embodiment, the attachment of this invention may include a pair of spaced tines each having a lifting plate mounted at the forward end, a leveling indicator mounted at the rearward end and a clamping device with a tie-down element. The lifting plate and tie-down element provide structure where chains, cable, rope or the like may be attached to secure or stabilize objects placed on the tines, and/or to assist in lifting items with the tines. The leveling indicator is mounted in a position on each tine so that it extends beneath the blade portion of the loader bucket and assists in maintaining the tines in a parallel, level orientation relative to the loader bucket.

The attachment of this invention may also include a stabilizer bar which connects between the two tines clamped onto the loader bucket. The stabilizer bar may include telescoping structure allowing it to adjust to different spacings between the tines, as required. Further, the stabilizer bar functions to add rigidity to the tines and resist flexing of one tine relative to the other under the application of load.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
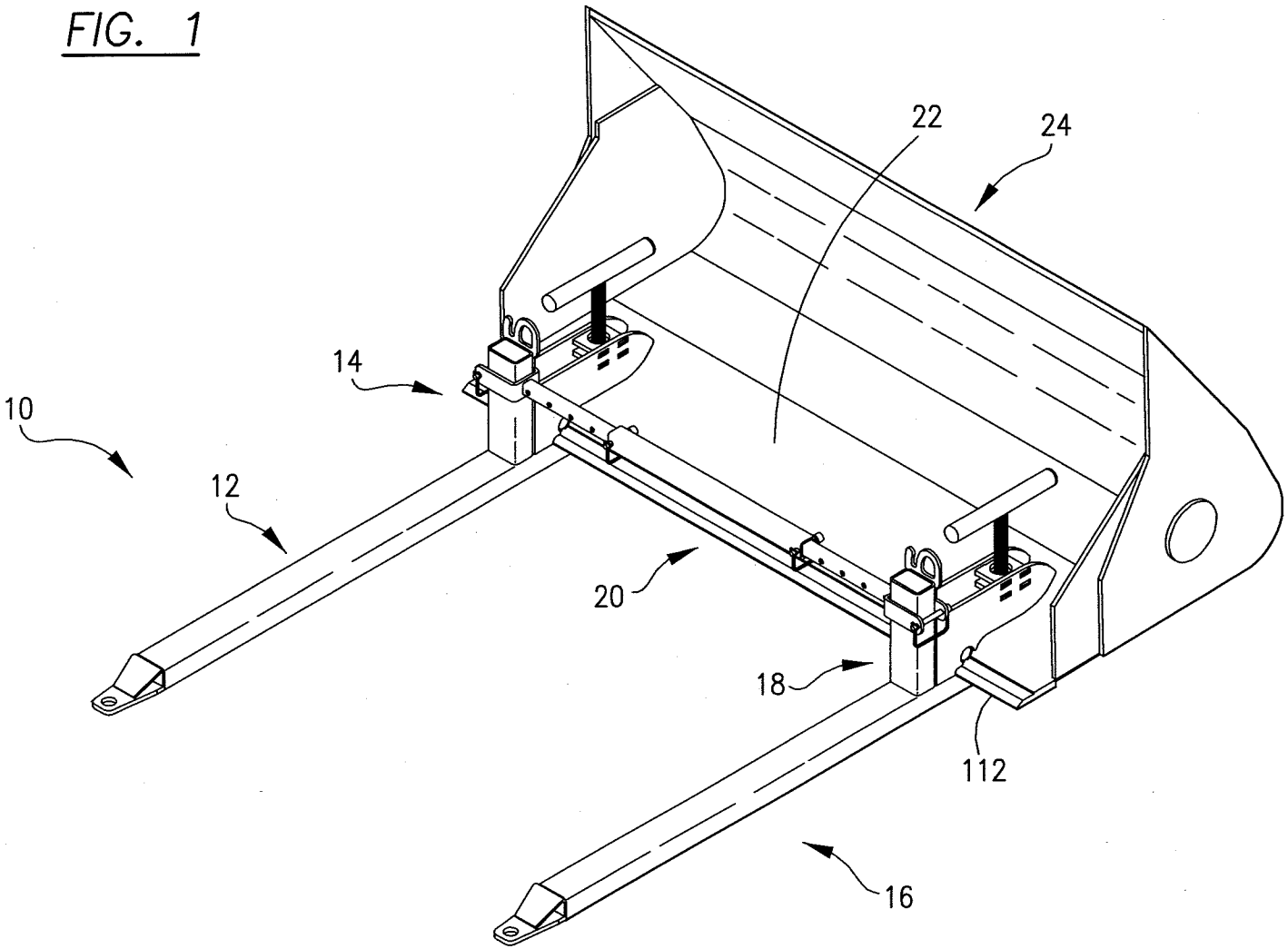
FIG. 1 is a perspective view of a loader bucket to which the clamp-on fork lift attachment of this invention is mounted.
Figure 2:
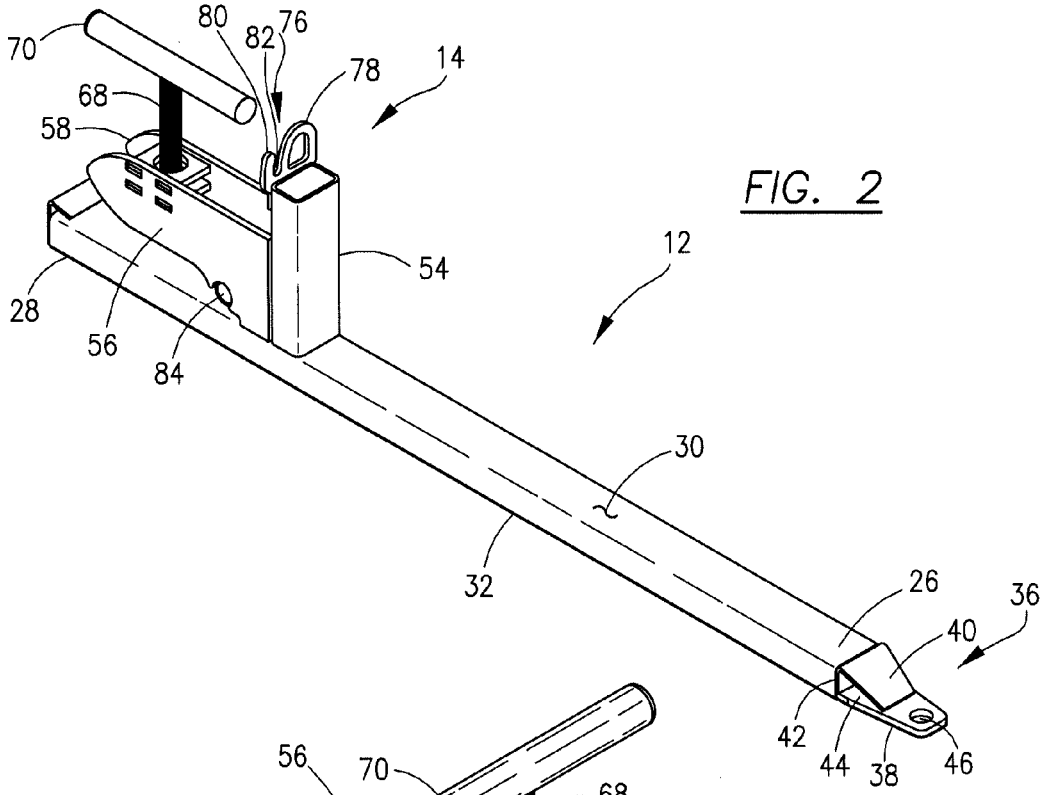
FIG. 2 is an enlarged perspective view of one of the tines here.

Referring now to the drawings, the clamp-on fork lift attachment 10 of this invention comprises a first tine 12 having a first clamping mechanism 14, a second tine 16 having a second clamping mechanism 18 and a stabilizer bar 20 which may be connected between the first and second clamping mechanisms 14, 18 of tines 12, 16. The attachment 10 may be mounted to the blade portion 22 of a loader bucket 24, illustrated schematically in FIG. 1, as described in detail below. The loader bucket 24 may be part of a backhoe loader, a front end loader or similar piece of equipment, not shown. For purposes of the present discussion, the terms "top," "bottom," "upper," "lower" and "vertical" refer to the orientation of the various components of the attachment 10 and the loader bucket 24 as depicted in the drawings.

As best seen in FIG. 1, the two tines 12, 16 and two clamping mechanisms 14, 16 have the same construction. Therefore, only the tine 12 and clamping mechanism 14 are described in detail herein it being understood that the same description applies to tine 16 and its clamping mechanism 18.

In one presently preferred embodiment, the tine 12 is formed from generally rectangular-shaped tube stock having a forward end 26, a rearward end 28, an upper surface 30, a lower surface 32 and a hollow interior 34. A lifting plate 36 is mounted at the forward end 26 of tine 12. The lifting plate 36 has a base 38, a leg section 40 and an end section 42 extending between the base 38 and leg section 40. Although the lifting plate 36 may be fabricated in separate pieces which are welded together, it is preferred that a single plate be bent such that the end section 42 is substantially perpendicular to the base 38 and the leg section 40 extends at an angle from the top of the end section 42 into contact with or at least immediately adjacent to the upper surface of the base 38. A cavity 44 is formed between the base 38 and leg section 40, and an aperture 46 may be formed in the base 38 which is spaced from the cavity 44. The cavity 44 and aperture 46 may receive a chain, cable, rope or other means of attachment for lifting an object which is not resting on the tines 12, 16, or for tying down a load on the tines 12, 16 so that it does not shift or fall off. Preferably, the lifting plate 36 is secured to the forward end 26 of tine 12 by welding the end section 42 thereto.

Figure 4:
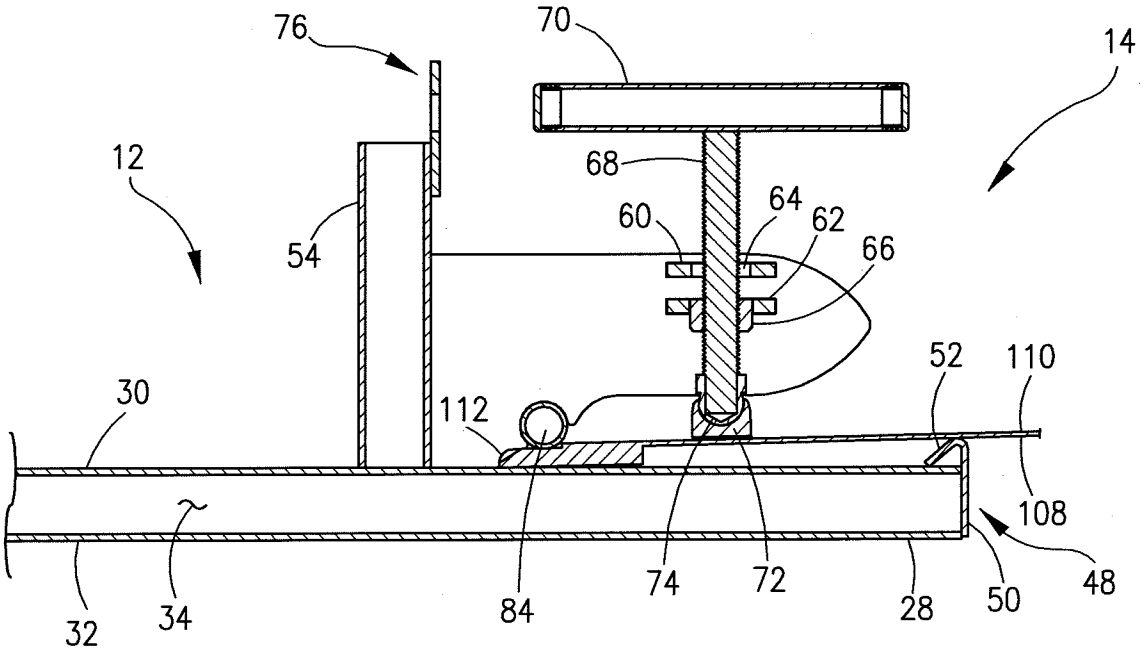
FIG. 4 is a further cross sectional view of the clamping mechanism employed with each tine of this invention.

A leveling indicator 48 is preferably mounted to the rearward end 28 of tine 12, as best seen in FIG. 4. The leveling indicator 48 comprises a vertically oriented end plate 50 whose upper end is bent at an angle to form a top section 52 which extends into contact with or immediately adjacent to the upper surface 30 of tine 12. The end plate 50 is preferably welded to the rearward end 28 of the tine 12 to secure the leveling indicator 48 in place. The purpose of the leveling indicator 48 is described below in connection with a discussion of clamping the attachment 10 to the loader bucket 24.

Figure 3:
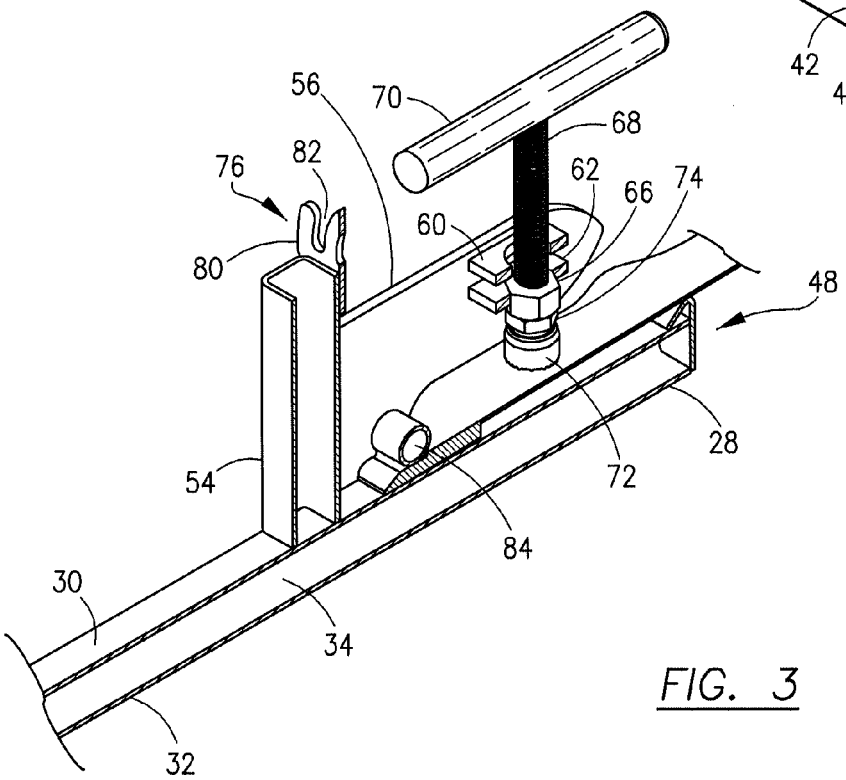
FIG. 3 is a partial cross sectional view of a tine depicting its clamping mechanism.

The clamping mechanism 14 includes a vertical support 54 mounted at its bottom end to the upper surface 30 of tine 12 near rearward end 28. A first arm 56 is welded along one side edge of the vertical support 54, and a second arm 58 attaches to its opposite side edge so that the arms 56, 58 are laterally spaced from one another and extend in a direction toward the rearward end 28 of tine 12. At least a portion of each arm 56, 58 rests atop the upper surface 30 of tine 12 and may be welded thereto. An upper guide bracket 60 and a lower guide bracket 62 are connected between the arms 56, 58. The upper guide bracket 60 is formed with an opening 64 that vertically aligns with an internally threaded nut 66 secured to the lower guide bracket 62. A threaded rod 68 may be inserted through the opening 64 in the upper guide bracket 60 and into threaded engagement with the nut 66 in the lower guide bracket 62, as shown in FIGS. 3 and 4. A handle 70 is mounted to the top end of the threaded rod 68 which is rotatable to move the threaded rod 68 in a direction toward and away from the upper surface 30 of tine 12. A clamping pad 72 is secured to the bottom end of the threaded rod 68, preferably with a ball-and-socket type of mount 74.

In one presently preferred embodiment, a tie-down element 76 is mounted to the upper end of the vertical support 54 of clamping mechanism 14. The tie-down element 76 includes a ring 78 and an extension 80 which is spaced from the ring 78 forming a slot 82 between them. The ring 78, extension 80 and slot 82 provide points of attachment for a chain, cable, rope of the like which may be used to secure items placed on the tines 12, 16 or other purposes. Additionally, a rod 84 is connected between and near the bottom portion of the arms 56, 58 of clamping mechanism 14, for purposes to become apparent below.

Figure 5:
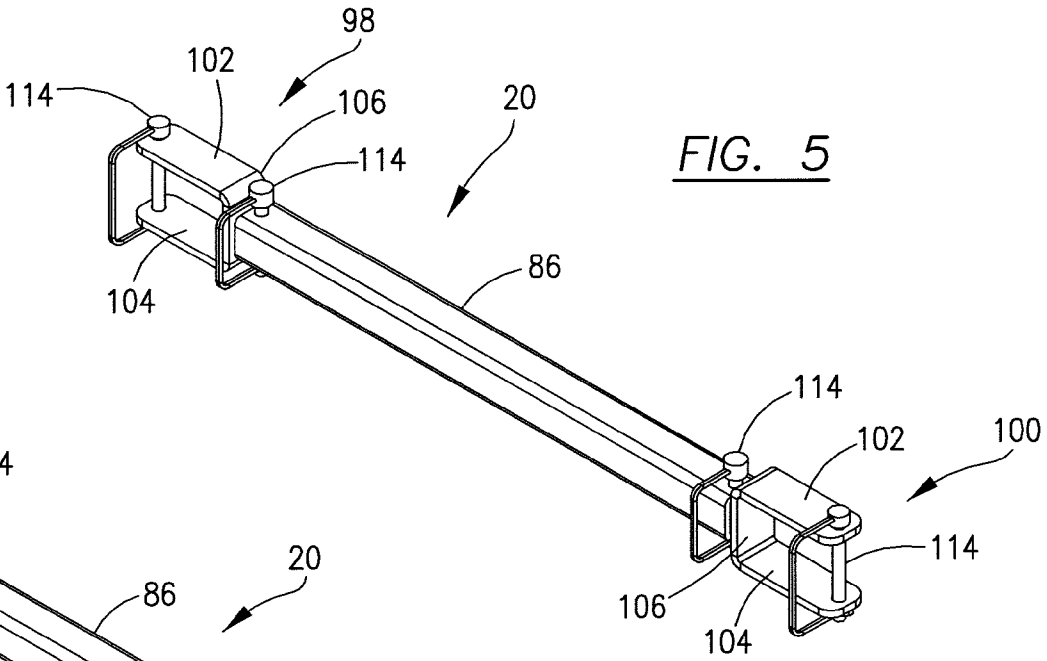
FIG. 5 is a perspective view of the stabilizer bar of this invention shown in the retracted position.
Figure 6:
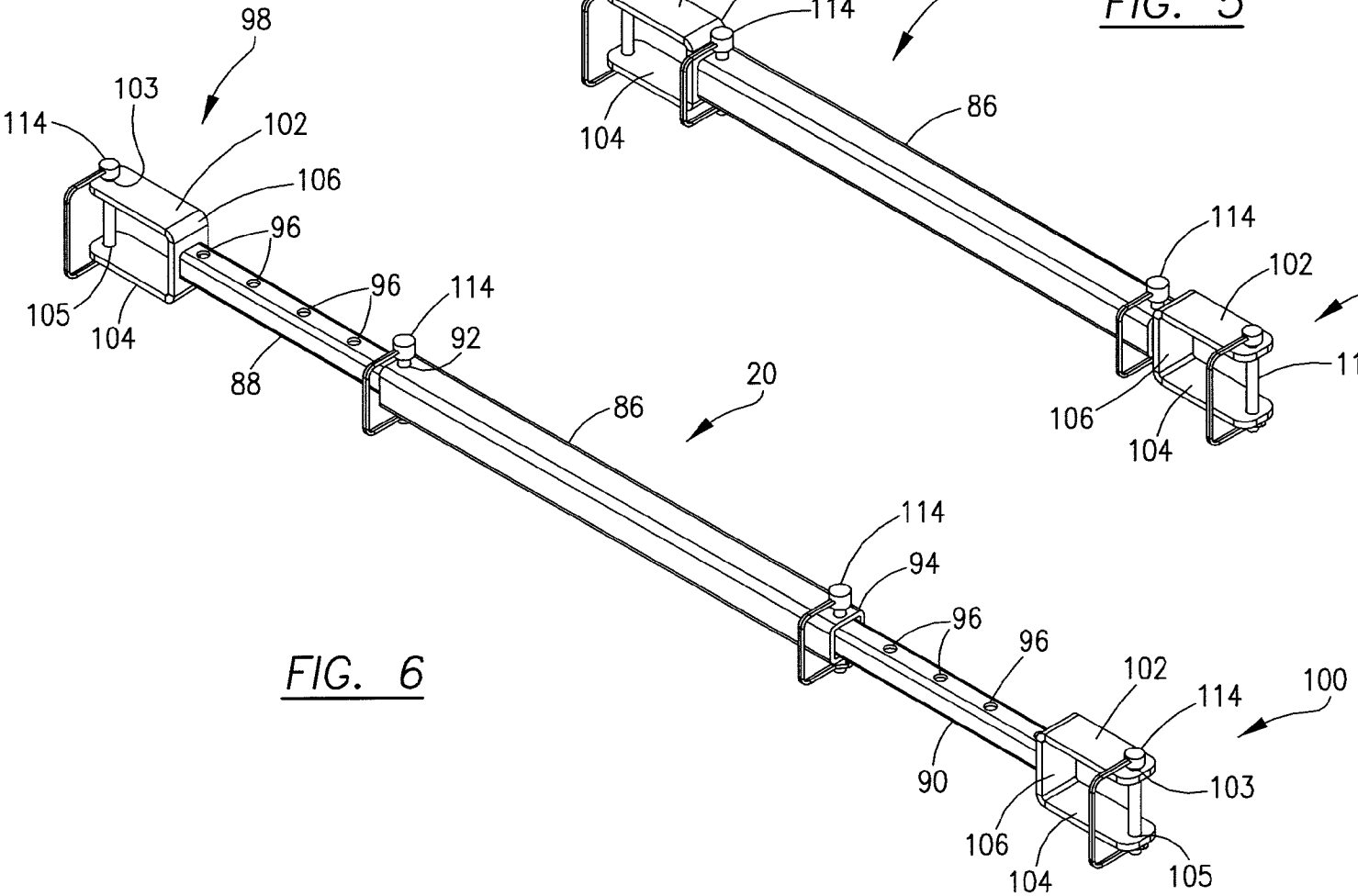
FIG. 6 is a perspective view of the stabilizer bar in its expanded position.

Referring now to FIGS. 5 and 6, the stabilizer bar 20 of attachment 10 is illustrated in more detail. In one presently preferred embodiment, the stabilizer bar 20 includes a center tube 86 having a hollow interior, and first and second end tubes 88, 90 which are received within and telescope relative to the hollow interior of center tube 86. The center tube 86 is formed with through bores 92 and 94 at opposite ends. Each of the end tubes 88, 90 may be hollow or solid, and are formed with a number of spaced through bores 96. A coupler 98 is mounted to the free end of the first end tube 88, and a second coupler 100 is connected to the free end of the second end tube 90. Each of the couplers 98, 100 may be in the form of a yoke having opposed side plates 102, 104 mounted to or integrally formed with a connector plate 106 which is welded or otherwise permanently attached to the free ends of the end tubes 88, 90. The side plates 102, 104 are formed with bores 103 and 105, respectively, which align with one another. The stabilizer bar 20 is mounted to attachment 10 as described below.

Referring now to FIGS. 1, 3 and 4, the attachment 10 of this invention may be temporarily mounted to the blade portion 22 of loader bucket 24 as follows. The rearward end 28 of tine 12 may be moved into position such that it extends along the bottom surface 108 of blade portion 22 and the clamping pad 72 of clamping mechanism 14 overlies the top surface 110 of blade portion 22. The top section 52 of the leveling indicator 48 contacts the bottom surface 108 and assists in ensuring that the tine 12 is not tilted but positioned in a substantially parallel, level orientation relative to the blade portion 22. In the course of moving the tine 12 and clamping mechanism 14 along the blade portion 22 of loader bucket 24, the cutting edge 112 of the loader bucket 24 engages the rod 84 of the clamping mechanism 14. The rod 84 acts as a stop to indicate when the tine 12 and clamping mechanism 14 are in position relative to the blade portion 22 so that the threaded rod 68 may be turned by handle 70 to move the clamping pad 72 vertically downwardly into contact with the top surface 110 of blade portion 22. Tightening down of the threaded rod 68 securely clamps the tine 12 into position on the loader bucket 24. The ball-and-socket mount 74 at the bottom end of the threaded rod 68 allows the clamping pad 72 to pivot and engage the top surface 110 of blade portion 22 along substantially its entire surface area even if the clamping mechanism 14 and bucket loader 24 are somewhat angled relative to one another and/or there are irregularities in the top surface 110 of blade portion 22.

The second tine 16 may be mounted to the loader bucket 24 in the same manner as tine 12 discussed above. When both tines 12, 16 are in position, the stabilizer bar 20 may be connected between them. The coupler 98 of end tube 88 of stabilizer bar 20 may be mounted to the clamping mechanism 14 of tine 12 by placing the vertical support 54 between the side plates 102, 104 and in engagement with connector plate 106. The ends of side plates 102, 104 clear the vertical support 54, and a pin 114 may be inserted into their aligning bores 103, 105 to secure the coupler 98 in place. The same procedure is employed in mounting the coupler 100 to the clamping mechanism 18 of the other tine 16. As noted above, the end tubes 88 and 90 telescope within center tube 86 so that the overall length of stabilizer bar 20 may be varied, depending on the spacing between tines 12 and 16, e.g. from a retracted position shown in FIG. 5 to an extended position illustrated in FIG. 6. In order to connect the end tubes 88,90 to the center tube 86, a pin 114 may be inserted through the bore 92 at one end of center tube 86 into an aligning bore 96 of the end tube 88, and a pin 114 may be inserted through the bore 94 at the other end of center tube 86 into an aligning bore 96 of end tube 90.

It is contemplated that the installation of attachment 10 described above may be varied if sufficient manpower is available. The stabilizer bar 20 may be mounted to the clamping devices 14, 18 of respective tines 12, 16 first, in the same manner noted above, and then the entire assembly may be moved into position for mounting to the blade portion 22 of loader bucket 24. This would avoid the potential issue of misalignment between the bores 92, 94 in the center tube 86, and one of the bores 96 in each of the end tubes 88, 90, which could occur if the tines 12, 16, when individually mounted to loader bucket 24, are not spaced from one another at the appropriate distance.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. For example, while one preferred embodiment of the present invention is a clamp-on fork lift attachment comprising two tines each mounted to the blade portion of a loader bucket with a space between them, it is contemplated that a single tine could be employed to form the attachment herein under circumstances such as when an object is to be lifted using a cable, chain rope or the like connected to the lifting plate and/or tie-down element of this invention. As such, the clamp-on fork lift attachment is considered to include at least one tine.

Therefore, it is intended that the invention not be limited to the particular embodiment disclosed as the best mode contemplated for carrying out this invention, but that the invention will include all embodiments falling within the scope of the appended claims.

We claim:

1. Apparatus for use with a loader bucket, comprising:

a first tine and a second tine, each of said first and second tines having a forward end, a rearward end and a first surface;

a first clamping mechanism mounted to said first tine, and a second clamping mechanism mounted to said second tine, said first and second clamping mechanisms being adapted to releasably mount said first and second tines to the loader bucket with a space between them;

a stabilizer bar comprising:

(i) a center tube having a hollow interior with opposed ends, said center tube being located between said first and second clamping mechanisms;

(ii) a first end tube having an inner end and an outer end mounted to said first clamping mechanism, one of said first end tube and said center tube being formed with a number of spaced first bores and the other being formed with at least one second bore, said inner end of said first end tube being insertable into one end of said hollow interior of said center tube so that said at least one second bore aligns with one of said spaced first bores in position to receive a fastener;

(iii) a second end tube having an inner end and an outer end mounted to said second clamping mechanism, one of said second end tube and said center tube being formed with a number of spaced third bores and the other being formed with at least one fourth bore, said inner end of said second end tube being insertable into the opposite end of said hollow interior of said center tube so that said at least one fourth bore aligns with on of said spaced third bores in position to receive a fastener.

2. The apparatus of claim 1 in which a first coupler is connected to said outer end of said first end tube and a second coupler is connected to said outer end of said second end tube, said first coupler being releasably connected to said first clamping mechanism and said second coupler being releasably connected to said second clamping mechanism.

3. The apparatus of claim 1 further including a lifting plate mounted to said forward end of each of said first and second tines.

4. The apparatus of claim 3 in which said lifting plate includes a base plate and a leg section connected to one another so that a cavity is formed between them.

5. The apparatus of claim 4 in which said base plate and said leg section are joined to opposite ends of a connector plate which is mounted to said forward end of each of said first and second tines, said leg section extending at an angle from one end of said connector plate toward said base plate.

6. The apparatus of claim 4 in which said base plate is formed with an aperture which is spaced from said leg section.

7. The apparatus of claim 1 further including a leveling indicator mounted to said rearward end of each of said first and second tines.

8. The apparatus of claim 7 in which each of said leveling indicators comprises an end plate having a first section mounted to said rearward end of one of said first and second tine and a second section extending from said first section toward said first surface of one of said first and second tines.

9. The apparatus of claim 1 in which each of said first and second clamping mechanisms comprises:

(i) an upright support mounted to said first surface of one of said first and second tines;

(ii) spaced first and second arms each connected at one end to said upright support;

(iii) a stop rod connected between said first and second arms;

(iv) a first guide bracket formed with an opening and a second guide bracket which mounts an internally threaded nut in alignment with said opening, said first and second guide brackets being spaced from one another and connected between said first and second arms;

(v) a threaded rod insertable through said opening in said first guide bracket and into threaded engagement with said threaded nut of said second guide bracket;

(vi) a handle mounted at one end of said threaded rod, and a clamping pad mounted at the opposite end of said threaded rod;

(vii) a tie-down element mounted to said upright support, said tie-down element including a ring and an extension spaced from said ring forming a slot between them.

10. The apparatus of claim 9 in which one end of said stabilizer bar is connected by a first coupler to said upright support of said first clamping mechanism, and an opposite end of said stabilizer bar is connected by a second coupler to said upright support of said second clamping mechanism.

11. The apparatus of claim 1 in which said first end tube is formed with said number of spaced first bores, and said second end tube is formed with said number of spaced third bores.

12. The apparatus of claim 1 in which said first and second end tubes are movable toward and away from one another within said hollow interior of said center tube to adjust said space between said first and second clamping mechanisms.

13. Apparatus for use with a loader bucket, comprising:

a first tine and a second tine, each of said first and second tines having a forward end, a rearward end and a first surface;

a lifting plate located at said forward end of each of said first and second tines, said lifting plate having a cavity capable of receiving an attachment element which is effective to lift an object or to tie down an object resting on said first and second tines;

a leveling indicator located at said rearward end of each of said first and second tines;

a first clamping mechanism mounted to said first tine, and a second clamping mechanism mounted to said second tine, said first and second clamping mechanisms being adapted to releasably mount said first and second tines to the loader bucket with a space between them;

a stabilizer bar connected at a first end to said first clamping mechanism of said first tine and connected at an opposite second end to said second clamping mechanism of said second tine;

said stabilizer bar includes a telescoping structure which is effective to extend and retract so that said stabilizer bar may be positioned to span said space between said first and second tines;

said telescoping structure of said stabilizer bar comprises:

a first end tube having an inner end, an outer end and being formed with a number of spaced bores;

a second end tube having an inner end, an outer end and being formed with a number of spaced bores;

a center tube having a hollow interior, a fist bore at one end and a second bore at an opposite end;

said inner end of said first end tube being inserted into said one end of said hollow interior of said center tube so that said first bore aligns with one of said spaced bores in said first end tube, said inner end of said second end tube being inserted into opposite end of said hollow interior of said center tube so that said second bore aligns with one of said spaced bores in said second end tube, a pin being inserted into said aligning bores of said first end tube; and said center tube and another pin being inserted into said aligning bore of said second end tube and said center tube to connect them together.

14. The apparatus of claim 13 in which a first coupler is connected to said outer end of said first end tube and a second coupler is connected to said outer end of said second end tube, said first coupler being releasably connected to said first clamping mechanism and said second coupler being releasably connected to said second clamping mechanism.

15. The apparatus of claim 13 in which said lifting plate mounted at the forward end of each of said first and second tines includes a base plate and a leg section connected to one another so that a cavity is formed between them.

16. The apparatus of claim 15 in which said base plate and said leg section are joined to opposite ends of a connector plate which is mounted to said forward end of each of said first and second tines, said leg section extending at an angle from one end of said connector plate toward said base plate.

17. The apparatus of claim 16 in which said base plate is formed with an aperture which is spaced from said leg section.

18. The apparatus of claim 13 in which each of said leveling indicators comprises an end plate having a first section mounted to said rearward end of one of said first and second tines and a second section extending from said first section toward said first surface of said one of said first and second tines.

19. The apparatus of claim 13 in which each of said first and second clamping mechanisms comprises:

(i) an upright support mounted to said first surface of one of said first and second tines;

(ii) spaced first and second arms each connected at one end to said upright support;

(iii) a stop rod connected between said first and second arms;

(iv) a first guide bracket formed with an opening and a second guide bracket which mounts an internally threaded nut in alignment with said opening, said first and second guide brackets being spaced from one another and connected between said first and second arms;

(v) a threaded rod insertable through said opening in said first guide bracket and into threaded engagement with said threaded nut of said second guide bracket;

(vi) a handle mounted at one end of said threaded rod, and a clamping pad mounted at the opposite end of said threaded rod;

(vii) a tie-down element mounted to said upright support, said tie-down element including a ring and an extension spaced from said ring forming a slot between them.

20. The apparatus of claim 9 in which one end of said stabilizer bar is connected by a first coupler to said upright support of said first clamping mechanism, and an opposite end of said stabilizer bar is connected by a second coupler to said upright support of said second clamping mechanism.

21. The apparatus of claim 13 in which said attachment element is a rope, cable or chain.

22. Apparatus for use with a loader bucket, comprising:

a first tine and a second tine, each of said first and second tines having a forward end, a rearward end and a first surface;

a lifting plate located at said forward end of each of said first and second tines;

a leveling indicator located at said rearward end of each of said first and second tines;

a first clamping mechanism mounted to said first tine and a second clamping mechanism mounted to said second tine, said first and second clamping mechanisms being adapted to releasably mount said first and second tines to the loader bucket with a space between them;

a stabilizer bar comprising:

(i) a center tube having a hollow interior with opposed ends, said center tube being located between said first and second clamping mechanisms;

(ii) a first end tube having an inner end and an outer end mounted to said first clamping mechanism, one of said first end tube and said center tube being formed with a number of spaced first bores and the other being formed with at least one second bore, said inner end of said first end tube being insertable into one end of said hollow interior of said center tube so that said at least one second bore aligns with one of said spaced first bores in position to receive a fastener;

(iii) a second end tube having an inner end and an outer end mounted to said second clamping mechanism, one of said second end tube and said center tube being formed with a number of spaced third bores and the other being formed with at least one fourth bore, said inner end of said second end tube being insertable into the opposite end of said hollow interior of said center tube so that said at least one fourth bore aligns with on of said spaced third bores in position to receive a fastener.

23. The apparatus of claim 22 in which a first coupler is connected to said outer end of said first end tube and a second coupler is connected to said outer end of said second end tube, said first coupler being releasably connected to said first clamping mechanism and said second coupler being releasably connected to said second clamping member.

24. The apparatus of claim 22 in which said first end tube is formed with said number of spaced first bores, and said second end tube is formed with said number of spaced third bores.

25. The apparatus of claim 22 in which said first and second end tubes are movable toward and away from one another within said hollow interior of said center tube to adjust said space between said first and second clamping mechanisms.

* * * * *